US007147541B2

(12) United States Patent
Nagayama et al.

(10) Patent No.: US 7,147,541 B2
(45) Date of Patent: Dec. 12, 2006

(54) THICKNESS CONTROL METHOD AND DOUBLE SIDE POLISHER

(75) Inventors: Hitoshi Nagayama, Yokohama (JP); Yusuke Inoue, Zama (JP)

(73) Assignee: Speedfam Co., Ltd., Ayase (JP)

( * ) Notice: Subject to any disclaimer, the term of this patent is extended or adjusted under 35 U.S.C. 154(b) by 0 days.

(21) Appl. No.: 11/359,397

(22) Filed: Feb. 23, 2006

(65) Prior Publication Data

US 2006/0194511 A1 Aug. 31, 2006

(30) Foreign Application Priority Data

Feb. 25, 2005 (JP) ..... 2005-050404

(51) Int. Cl.
*B24B 49/00* (2006.01)

(52) U.S. Cl. ..... 451/5; 451/10; 451/11; 451/41; 451/262; 451/269; 451/287

(58) Field of Classification Search ..... 451/5, 451/8, 9, 10, 11, 41, 262, 268, 269, 285, 287, 451/288

See application file for complete search history.

(56) References Cited

U.S. PATENT DOCUMENTS

| | | | | |
|---|---|---|---|---|
| 4,272,924 | A * | 6/1981 | Masuko et al. | 451/1 |
| 4,433,510 | A * | 2/1984 | Katagiri et al. | 451/5 |
| 5,099,614 | A * | 3/1992 | Arai et al. | 451/8 |
| 6,062,949 | A * | 5/2000 | Yashiki et al. | 451/10 |
| 6,726,525 | B1 * | 4/2004 | Kato et al. | 451/5 |
| 6,887,127 | B1 * | 5/2005 | Nishikawa et al. | 451/6 |
| 7,001,242 | B1 * | 2/2006 | Birang et al. | 451/5 |
| 7,004,816 | B1 * | 2/2006 | Saitoh | 451/10 |
| 7,008,308 | B1 * | 3/2006 | Bjelopavlic et al. | 451/269 |
| 2002/0115387 | A1 * | 8/2002 | Wenski et al. | 451/41 |

FOREIGN PATENT DOCUMENTS

| | | |
|---|---|---|
| JP | 56-146666 | 11/1981 |
| JP | 57-076406 | 5/1982 |
| JP | 63-062673 | 3/1988 |
| JP | 02-224968 | 9/1990 |
| JP | 10-034529 | 2/1998 |
| JP | 10-202514 | 8/1998 |
| JP | 2000-127031 | 5/2000 |
| JP | 2003-117809 | 4/2003 |

* cited by examiner

*Primary Examiner*—Eileen P. Morgan
(74) *Attorney, Agent, or Firm*—Morrison & Foerster LLP

(57) ABSTRACT

The object of the present invention is to provide a double side polisher capable of maintaining thickness control accuracy over a long period of time without being affected by a gradual change in thickness of a polishing pad, and a thickness control method. The first polishing operation is finished based on the polishing duration time, and the second and subsequent polishing operations are finished based on the measured distance values of a distance sensor, and after each polishing operation including the first polishing, the measured value of the distance sensor is calibrated based on the measured value and target value of finishing thickness of the work piece. Since the calibration is performed for each polishing operation, it is possible to maintain thickness control accuracy over a long period of time.

6 Claims, 3 Drawing Sheets

THICKNESS CONTROL METHOD AND DOUBLE SIDE POLISHER

This application is based on application No. 2005-050404 filed in Japan, the contents of which are hereby incorporated by reference.

FIELD OF THE INVENTION

The present invention relates to a double side polisher for a work piece and a thickness control method thereof.

BACKGROUND OF THE INVENTION

A double side polisher is a machine that polishes surfaces of both sides of a work piece at the same time. The work pieces are inserted in holes of a carrier respectively and the carrier with the work pieces is placed between upper and lower polishing plates on which polishing pads are plastered. Then, a planetary motion is provided to the carrier and a rotary motion is provided to the upper and lower polishing plates, while supplying slurry in the gap of the polishing plates and applying a predetermined polishing pressure to the work pieces by the polishing plates.

Although the amount of polishing of the work piece is usually monitored by means of polishing duration time, there is a case where it is necessary to detect the amount of polishing or material removal. Therefore, there are made some attempts to provide a thickness control device in a polishing apparatus.

Conventionally, there is known a thickness control device using a probe as disclosed in Japanese Examined Patent Publication No. S64-4126. The thickness control device disclosed in the document has a construction wherein a stylus of the probe is directed upward and the upper end of the stylus is in contact with the measurement chip fixed to the upper polishing plate. As the upper polishing plate goes down, with the advance of polishing, the chip of the upper polishing plate pushes down the stylus of the probe and the displacement, namely the amount of polishing, is measured by the probe.

Also, there is known another thickness control device using an eddy current distance sensor as disclosed in Japanese Examined Patent Publication No. S63-9943. This device mounted on the upper polishing plate measures the change of distance from itself to the lower polishing plate by detecting the change of impedance of the sensor.

Furthermore, in the thickness control device disclosed in Japanese Unexamined Patent Publication No. H10-202514, a reference aluminum plate is provided on the carrier, and distance L1 to the upper surface of the reference plate and distance L2 to the upper surface of an aluminum disk, or a work piece, are measured by the eddy current sensor and a difference between distances L1 and L2 is calculated to determine the thickness of the aluminum disk (work piece).

SUMMARY OF THE INVENTION

In the first document, it is assumed that the amount of downward displacement of the upper polishing plate corresponds to the amount of material removal from the work piece. However, as the upper and lower polishing plates are worn while lapping operations are repeated, the displacement of the upper polishing plate becomes no longer correspond to the amount of material removal when many work pieces are polished. Thus accuracy of the thickness control falls gradually.

Moreover, since the stylus is in contact with the chip, the contact end of the stylus is abraded by rotation of the chip and error in measurement may occur. Because of this, accuracy the thickness control is about ±4 to 5 μm and thus it is difficult to achieve an accuracy of ±3 μm or less.

In contrast, in the thickness control device using the eddy current sensor disclosed in the second Document, the distance between the upper and lower polishing plates is detected by radiating magnetic field from the eddy current sensor to the lower polishing plate, which allows for measurements including the wear of the lower polishing plate, and also allows the measurement of the work piece to an accuracy of ±3 μm or less, since measurement error decreases compared with the thickness control device disclosed in the first document.

However, accuracy achieved by the above thickness control device is not enough to satisfy the level recently required as the measurement is influenced by deformation of polishing pad caused by polishing pressure.

The thickness control device disclosed in the third document is limited for electrical conductive materials and cannot be applied for polishing work pieces made of semiconductor, glass or crystal as they are not electrically conductive.

In the double side polisher, polishing pad is attached or plastered to each of the upper and lower constant polishing plates and work pieces are sandwiched between them. The polishing pad made of unwoven fabric or rigid urethane foam and with a thickness of equal to or greater than the thickness of a semiconductor wafer, or a work piece, is typically used. The pad gradually deforms over time during a continuous operation, due to various factors such as abrasion, compression, and swelling, since the pad is always exposed to aqueous slurry and subjected to a polishing pressure repeatedly.

As the thickness of the pad changes over time and the pad is thick relatively to work pieces, the amount of this change is not negligible. This leads to a problem that, even if such a thickness control device as described above may be used, measured values drift, and hence it is impossible to maintain the accuracy over a long period of time.

An object of the present invention is to provide a double side polisher capable of maintaining accuracy of thickness control over a long period of time without being affected effectively by the thickness change of a polishing plate, and a thickness control method for a double side polisher.

The aforementioned problems can be solved by the following means. That is, the first aspect of the present invention is a thickness control method for a double side polisher having: a lower polishing plate on the upper surface of which a polishing pad being attached rotatably supported on the machine base; a sun gear with external teeth rotatably supported on said machine base; an internal gear with internal teeth rotatably supported on said machine base; a carrier with external teeth for meshing with said external teeth of said sun gear and said internal teeth of said internal gear having holes for work pieces to be inserted therein; a rotatable upper polishing plate, on the lower surface of which a polishing pad being attached, for applying polishing pressure to said work pieces inserted in said holes; a drive system with a singularity of or a plurality of driving sources for rotating said upper and lower polishing plates, said sun gear and said internal gear on the same axis; a slurry supplying unit for supplying slurry to polishing area; a timer for measuring polishing duration time; and a distance sensor mounted in a cavity of said upper polishing plate for measuring distance to the upper surface of said carrier;

comprising following steps: (a). finishing a polishing operation for work pieces belonging to the first polishing group based on polishing duration time monitored by said timer; (b). calibrating said distance sensor based on the difference between the thickness calculated from the value measured by said distance sensor and the thickness of the work piece polished at the last polishing operation measured by an external thickness measuring apparatus; (c). finishing polishing operations for work pieces belonging to the second polishing group or the subsequent groups based on the distance value monitored by said distance sensor; and (d). repeating said steps b and c.

The second aspect of the present invention is a thickness control method according to claim 1, wherein: said distance sensor is an eddy current sensor; and said carrier, at least upper surface thereof, is made of electrically conductive material.

The third aspect of the present invention is a double side polisher comprising: a lower polishing plate on the upper surface of which a polishing pad being attached rotatably supported on the machine base; a sun gear with external teeth rotatably supported on said machine base; an internal gear with internal teeth rotatably supported on said machine base; a carrier with external teeth for meshing with said external teeth of said sun gear and said internal teeth of said internal gear having holes for work pieces to be inserted therein; a rotatable upper polishing plate, on the lower surface of which a polishing pad being attached, for applying polishing pressure to said work pieces inserted in said holes; a drive system with a singularity of or a plurality of driving sources for rotating said upper and lower polishing plates, said sun gear and said internal gear on the same axis; a slurry supplying unit for supplying slurry to polishing area; a timer for measuring polishing duration time; a distance sensor mounted in a cavity of said upper polishing plate for measuring distance to the upper surface of said carrier; and a control unit for controlling: polishing operation for work pieces belonging to the first polishing group to start and finish based on polishing duration time being monitored; and polishing operation for work pieces belonging to the second polishing group and the subsequent groups to start after the calibration of said distance sensor based on the difference between the thickness calculated from the value measured by said distance sensor and the thickness of the work piece polished at the last polishing operation measured by an external thickness measuring apparatus and to finish based on the distance value monitored by said distance sensor.

The fourth aspect of the present invention is a double side polisher according to claim 3, wherein: said control unit comprises: a target value storage unit to store the target values of finishing thickness of the work pieces; and a calibration unit for executing said calibration of said distance sensor.

The fifth aspect of the present invention is a double side polisher according to claim 4, wherein: said control unit further comprises: a sensor measurement storage for storing distance values measured by said distance sensor; and a work piece measurement storage for storing the measured values of thickness of the finished work pieces.

The sixth aspect of the present invention is a double side polisher according to claims 3 to 5, wherein: said distance sensor is an eddy current sensor; and said carrier, at least upper surface thereof, is made of electrically conductive material.

According to the double side polisher and the thickness control method of the present invention, calibration of the drift in measured value caused by the change in thickness of the polishing pad due to various factors such as abrasion, compression, swelling, etc. is performed after each polishing operation, and therefore it is possible to maintain a thickness control performance with high accuracy over a long period of time. In addition, since the distance to the surface of the carrier is measured, it is possible to apply the present invention to such nonconductive work pieces as semiconductor wafers without depending on their electrical property.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of various embodiments of the invention, and therefore reference is made to the claims which follow the description for determining the scope of the invention.

BRIEF DESCRIPTION OF THE DRAWINGS

The accompanying drawings, which are incorporated in and constitute a part of the specification, illustrate embodiments of the invention and together with the description, serve to explain the principles of the invention.

DETAILED DESCRIPTION OF THE PREFERRED EMBODIMENTS

Now, preferred embodiments of the present invention will be described in detail while referring to the accompanying drawings.

Figure 1:
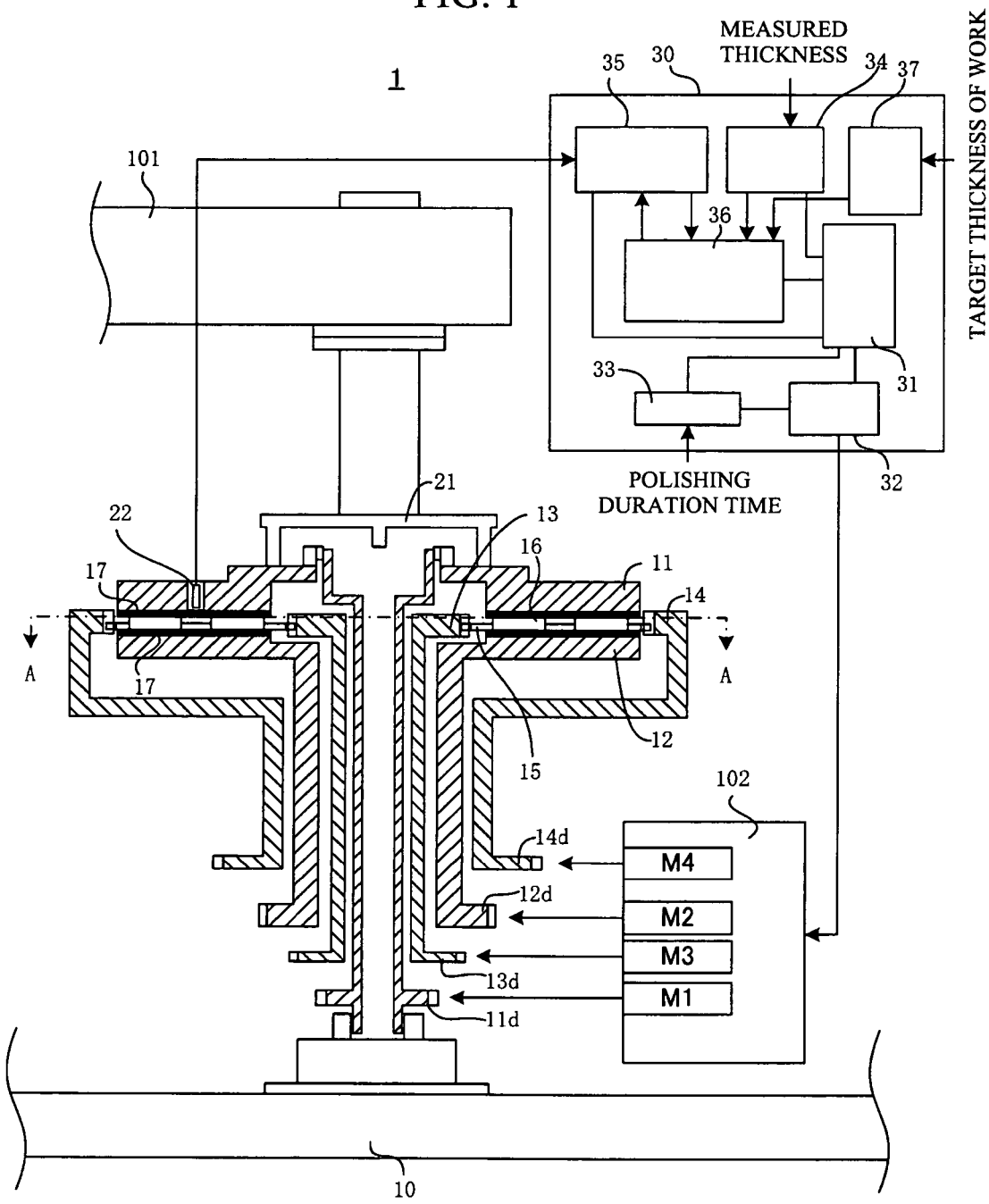
FIG. 1 is a vertical cross sectional view showing the substantial part of a double side polisher according to the present invention.
Figure 2:
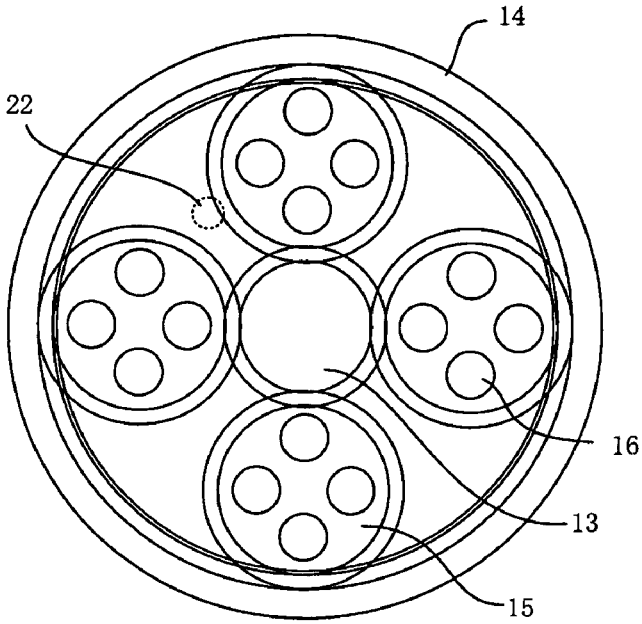
FIG. 2 is a plan view of FIG. 1 as seen from A—A in FIG. 1.

FIG. 1 shows a substantial part of an example of double side polisher according to the present invention. FIG. 2 is a plan view as seen from A—A of FIG. 1.

An upper polishing plate 11, a lower polishing plate 12, a sun gear, and an internal gear 14 are supported rotatably around the same axis on a machine base 10. The upper polishing plate 11 , the lower polishing plate 12, sun gear 13, and internal gear 14 have integrally a first drive gear 11*d*, a second drive gear 12*d*, a third drive gear 13*d*, and a fourth drive gear 14*d* respectively in order to transmit rotation power. To these gears, rotation power from a first motor M1, a second motor M2, a third motor M3, and a fourth motor M4 are transmitted respectively. Although a drive unit 102 shown here consists of four motors, it is possible to drive respective gears with a single motor by distributing its power by means of a gear train.

A polishing pad made of nonwoven fabric, rigid urethane foam, or the like is attached or plastered on the lower flat surface of the upper polishing plate 11 and the upper flat surface of the lower polishing plate 12, and the plates 11 and 12 are disposed so that the flat surfaces thereof face each other. In the gap between these surfaces is disposed a carrier 15. The carrier 15 thinner than the work piece 16 has external teeth meshing with the sun gear 13 and the internal gear 14.

The upper polishing plate 11 and the first drive gear 11*d* are arranged so that they can engage at lower position or disengage at upper position of the plates 11. It is possible to lift only the upper polishing plate 11 by an appropriate lifting means provided on a suspending member 21 and a beam 101. The carrier 15 is inserted from space created when the upper polishing plate 11 is lifted. At this time, the external teeth of the carrier 15 are engaged with the external teeth of the sun gear 13 and the internal teeth of the internal gear 14. The carrier 15 has a number of work piece holding holes in which flat work pieces 16 such as semiconductor wafers are mounted or inserted. Into the gap between the upper polishing plate 11 and the lower polishing plate 12, slurry is supplied from a slurry supply unit (not shown).

The upper polishing plate 11 has a cavity that opens downward and the distance sensor 22 is inserted therein. The distance sensor 22 is directed downward and measures a distance from the reference position of the distance sensor 22 to an upper surface 151 of the carrier 15.

Any type of sensor, that is, a sensor capable of measuring the distance to the surface of the carrier 15 may be used as the distance sensor 22. For example, if the surface of the carrier is electrically conductive, an eddy current sensor is may be used.

The control unit 30 comprises a main control unit 31, a drive control unit 32, a timer 33, a work piece measurement storage unit 34, a sensor measurements storage unit 35, a sensor measurements calibration unit 36, and a work piece targets storage unit 37.

The drive control unit 32 controls the drive unit 102 in response to a command from the main control unit 31. The timer 33 can be set polishing duration time, and can output a time end signal when a polishing duration time has passed. The value as a work piece measurement value is stored in the work piece measurement storage unit 34, at each time one polishing operation is finished.

The sensor measurements storage unit 35 stores, as a sensor measured value, the distance to the carrier that was measured by the distance sensor 22. The work piece targets storage unit 37 stores a target value of the finishing thickness of a work piece as a work piece target value.

The main storage unit 31 causes the polishing to be finished based on a polishing duration time set in the timer 33 for the first polishing operation for the work piece 16, and based on the measured distances of the distance sensor 22 for the second and subsequent polishing operations. At this time, the sensor measurements calibration unit 36 calibrates the measured values of the distance sensor after each polishing operation including the first one is finished, based on the difference between the measured value of finishing thickness of the work piece stored in the work piece measurement storage unit 34 and the target value of finishing thickness thereof stored in the work piece targets storage unit 37. The control and operation of an entire apparatus will be described later.

When polishing, the carrier 15 is placed on the lower polishing plate 12 to which the polishing pad 17 is attached, the external teeth of the carrier 15 are engaged with the sun gear 13 and internal gear 14, the work piece 16 is set in the work piece holding hole of the carrier 15, and the upper polishing plate 11 is lowered. Then, slurry is supplied from a slurry supply unit into the gap between the upper and lower polishing plates 11, 12, and the plates 11, 12, sun gear 13, and the internal gear 14 are driven to rotate. Since the carrier 15 is rotated by the sun gear 13 and internal gear 14, the work pieces 16 are polished by each polishing pad 17 of the plates 11 and 12, a polishing pressure from the upper polishing plate 11, and the slurry, while in planetary motion.

Figure 3:
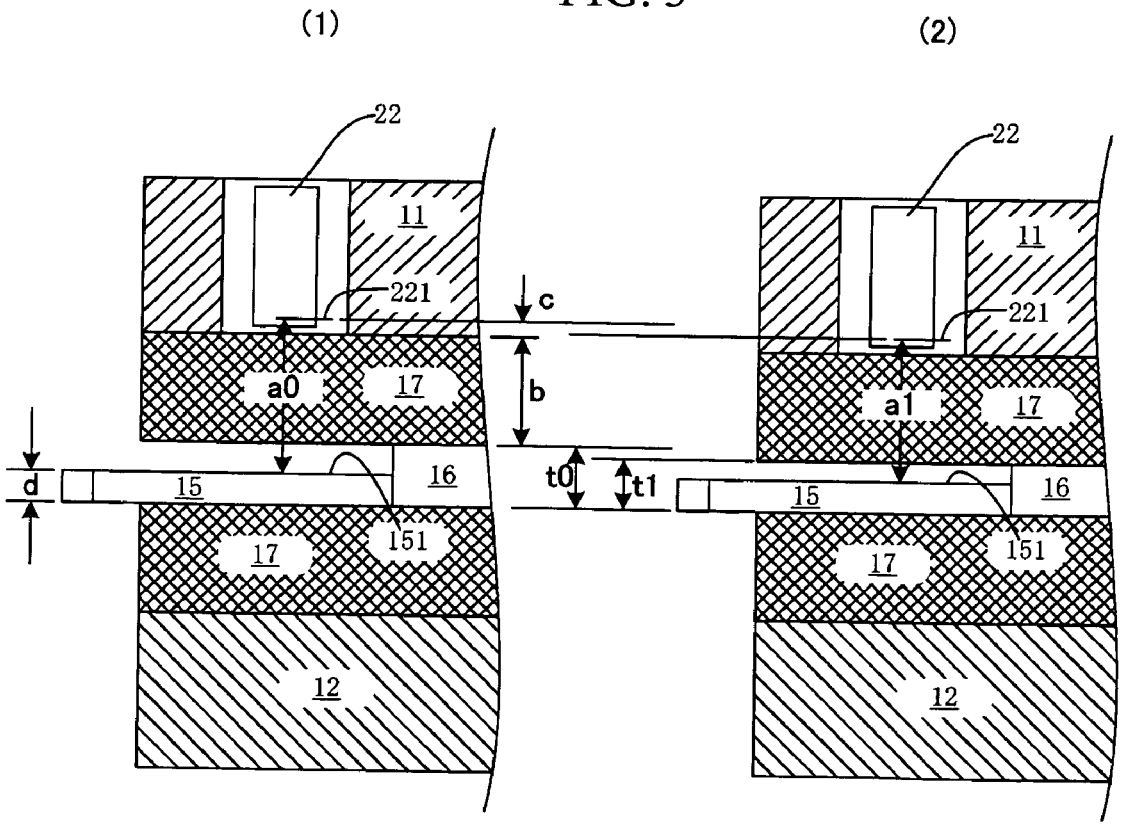
FIG. 3 is a comparative diagram illustrating a thickness control operation: (1) is a cross sectional view of the substantial part at the start of polishing and (2) is at the end of polishing.

FIG. 3 is an enlarged view of a substantial part of FIG. 1 to show thickness control operation for each polishing operation: (1) is a cross sectional view of the substantial part at the beginning of each polishing operation, and (2) is the view at the end of the each polishing operation.

Here, "t0" and "a0" denote respectively the thickness "t" of the work piece 16 and the distance "a" from the reference position of the distance sensor 22 to the surface position of the work piece 16 at the beginning of polishing. "d" and denotes the thickness of the carrier 15 which keeps contact with the polishing pad 17 of the lower polishing plate 12 through-out the polishing operation.

As a polishing starts and progresses, the work piece 16 is polished and its thickness "t" is reduced, causing the measured value of distance "a" of the measuring sensor to gradually decrease from the initial "a0". Provided that the thickness of the upper polishing pad 17 does not change during this period, the amount of decrease in measured value "a" of the distance corresponds to the amount of decrease in thickness "t" of the work piece 16. If initial thickness "t0" of the work piece 16 is previously known, a current value of thickness "t" of the work piece 16 is determined by monitoring distance "a" with the distance sensor 22.

Conversely, it is possible to obtain a work piece 16 having desired thickness "t1", when polishing is ceased at the time measured value "a" has reached the target value "a1" calculated from target value "t1" of the work piece.

The above description assumes that thickness "b" of the abrasive cloth 17 does not change during one polishing operation. However, this assumption does not hold true for a long period of time for the reason described before. That is, in the double side polisher 1, a polishing operation is repeated many times for continuous operation, and during this period the polishing pad 17 is always exposed to aqueous slurry and subjected to a polishing pressure repeatedly, and therefore thickness of the polishing pad gradually changes over time during the continuous operation due to various factors such as abrasion, compression, and swelling.

The relation of values is as follows.

$$t=a-b+d-c$$

Here, "b" and "c" denote respectively thickness of the polishing pad 17 and vertical distance from the reference position 221 of the distance sensor 22 to the lower surface of the upper polishing plate 11 (FIG. 3).

As thickness "b" of the polishing pad 17 changes slowly over a long period of time from the reason described above, indirectly monitored thickness "t" becomes no longer to represent accurate thickness of work piece.

Figure 4:
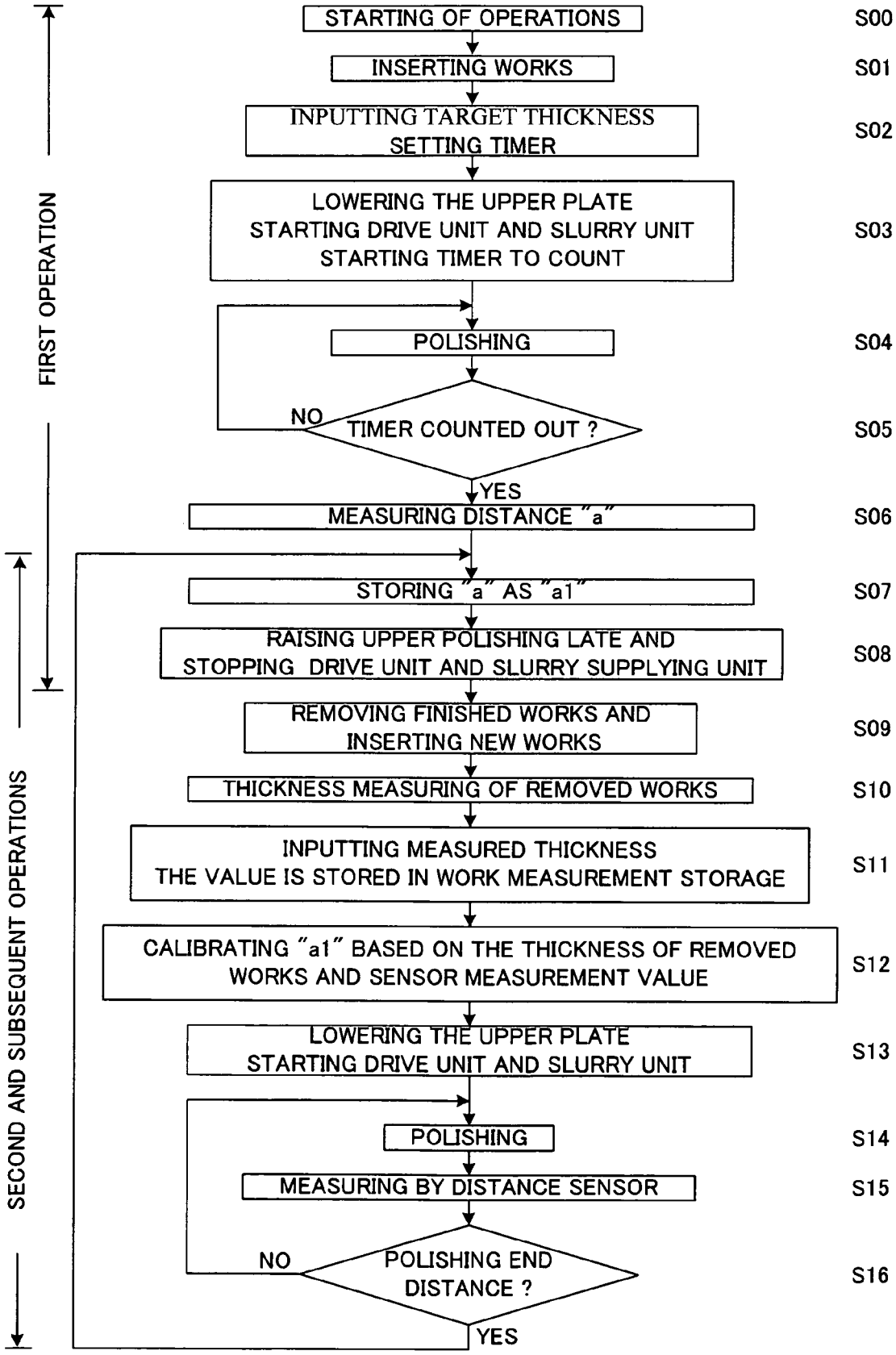
FIG. 4 is a flowchart describing the operation of a double side polisher of this embodiment including a calibration processing.

According to the present invention, accuracy of the thickness "t" can be kept in an permissible zone by calibration or correction. FIG. 4 is a flowchart of the operation of the double side polisher 1 of this embodiment including the aforementioned correction processing.

The flow shown in FIG. 4 consists of two parts: steps S00 through S08 are for the first polishing operation in which polishing termination control is performed by the timer, steps S07 through S16 are for the second and subsequent polishing operations in which polishing termination control is carried out by the distance sensor.

A polishing operation starts at step S00. It is assumed that, at this time, the upper polishing plate 11 is already lifted by an appropriate lifting means provided on the suspending member 21 and beam 101 and the carrier 15 is set in the polisher 1. At step S01, the operator inserts work pieces 16 in holes of the carrier 15.

At step S02, the operator inputs a target value of the finishing thickness of the work pieces 16 to the work piece targets storage unit 37. Also, the operator sets polishing end time calculated based on the predicted polishing rate and pre-measured thickness of the work piece 16 in the timer 33. The pre-measurement of the thickness of the work piece 16, calculation of the polishing end time, and setting the timer are performed only at the first polishing operation.

Then, the control unit 30 lowers the upper polishing plate 11, starts the drive unit 102 and slurry supply unit (not shown), and starts the timer 33, at step S03. When the upper polishing plate 11, lower polishing plate 12, sun gear 13, and internal gear 14 are driven and slurry is supplied, a polishing of the work piece 16 starts (S04). During this time, the value of the timer 33 is monitored, and it is repeatedly checked whether the initially set polishing duration time has passed or not.

When the timer 33 has counted out the polishing duration time (polishing time ends), step S06 starts. At the step S06, the distance "a" from the distance sensor 22 to the upper surface of the carrier 15 is measured, and then the measured value "a1" is stored in the sensor measurements storage unit 35 (S07). Then the control unit 30 raises the upper polishing plate 11 and stops the drive unit 102 and the slurry supply unit.

Next, at S09, the operator removes the polished first work pieces 16 and sets new work pieces 16 in the holding holes of the carrier 15. The removed work pieces 16 are measured for thickness by an external measuring device (S10).

This thickness measurement may be for one or few or all of the plurality of work pieces, and when measuring all the work pieces an average value is taken as a measured value. When the operator inputs this measured thickness value from the input device provided in the control unit 30, the value is stored in the work piece measurement storage unit 34 (S11).

The sensor measurements calibration unit 36 calibrates the polishing end distance "a1", based on the thickness of the finished work pieces (actual measurement values) stored in the work piece measurement storage unit 34, the distance value measured by the distance sensor and stored in the sensor measurements storage unit 35, and the thickness target value of the finished work pieces stored in the work piece target values storage unit 37 (S12).

The calibration at step S12 is performed as follows. If the measured value of the thickness of the work piece is greater than the target value (i.e., too thick), the amount of polishing is insufficient and therefore the polishing end distance value "a1" is decreased. Conversely, if the measured value of the work piece thickness is smaller than the target value (too thin), the amount of polishing is excessive and hence the polishing end distance value "a1" is increased. Since this operation is repeated as described below, the calibration of the polishing end distance "a1" is performed for each polishing operation.

On completion of the calibration processing, the control unit 30 lowers the upper polishing plate, drives the drive unit 102 via the drive control unit 32 (S13) and drives the slurry supply unit and starts the next polishing operation (S14). During the polishing, the distance between the distance sensor 22 and the upper surface of the carrier 15 is measured by the distance sensor 22 (S15), and the measured value "a" is checked for the polishing end distance "a1" (S16). When the measured value "a" becomes the polishing end distance "a1", control returns to S07 and steps S07 through S16 are repeated.

Although, in the above example, the control unit is composed of the drive control unit 32, timer 33, work piece measurement storage unit 34, sensor measurements storage unit 35, sensor measurements correction unit 36, and work piece target values storage unit, it is also possible to input a manually calculated or assumed correction value, based on the work piece measurement value and sensor measurement value, to the sensor measurements storage unit 36. In this case, the work piece measurement storage unit 34 and sensor measurements storage unit 35 are not necessary.

As described above, the double side polisher according to the present invention and this embodiment has a function of calibrating the polishing end distance "a1", and therefore even if the polishing pad 17 changes in thickness due to abrasion, compression, swelling, etc. the polishing end distance "a1" is corrected each time polishing is done, thus allowing the finishing thickness to be maintained within a certain margin of error.

Also, since the second and subsequent polishing operations are monitored by the distance sensor 22 for the progress of polishing, it is not necessary to measure the thickness before polishing as in the first polishing, or to predict the polishing rate, thus allowing an inexperienced operator to operate this double side polisher except for the first polishing.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. A thickness control method for a double side polishers, comprising:

providing a double side polisher comprising, a lower polishing plate rotatably supported on a machine base and comprising a polishing pad disposed on an upper surface thereof, a sun gear comprising external teeth and rotatably supported on the machine base, an internal gear comprising internal teeth and rotatably supported on the machine base, a carrier comprising external teeth for engaging with the external teeth of sun gear and internal teeth of the internal gear and having holes for work pieces to be inserted therein, an upper polishing plate comprising a polishing pad disposed on a lower surface thereof and configured to apply a polishing pressure to the work pieces inserted in the holes, the upper polishing plate being rotatably supported on the machine base, a drive system for rotating the upper and lower polishing plates, the sun gear and the internal gear around the same axis, a slurry supplying unit for supplying a slurry to the work pieces, a timer for measuring a polishing duration time, and a distance sensor mounted in a cavity of the upper polishing plate for measuring a distance from the distance sensor to an upper surface of the carrier;

finishing a polishing operation for work pieces belonging to a first polishing group using the double side polisher and based on the polishing duration time measured by the timer;

calibrating the distance sensor based on a difference between a thickness of the work pieces of the first polishing group calculated from the distance measured by the distance sensor and a thickness of the polished work pieces of the first polishing group measured by an external thickness measuring apparatus;

finishing a polishing operation for work pieces belonging to a second polishing group using the double side polisher and based on the distance measured by the calibrated distance sensor; and calibrating the distance sensor again based on a difference between a thickness of the work pieces of the second polishing group calculated from the distance measured by the distance sensor and a thickness of the polished work pieces of the second polishing group measured by the external thickness measuring apparatus.

2. A thickness control method according to claim 1, wherein the distance sensor is an eddy current sensor and the carrier comprises a conductive upper surface.

3. A double side polisher comprising:

a lower polishing plate rotatably supported on a machine base and comprising a polishing pad disposed on an upper surface thereof;

a sun gear comprising external teeth and rotatably supported on the machine base;

an internal gear comprising internal teeth and rotatably supported on the machine base;

a carrier comprising external teeth for engaging with the external teeth of the sun gear and the internal teeth of the internal gear and having holes for work pieces to be inserted therein;

an upper polishing plate, comprising a polishing pad disposed on a lower surface thereof and configured to apply a polishing pressure to the work pieces inserted in the holes, the upper polishing plate being rotatably supported on the machine base;

a drive system for rotating the upper and lower polishing plates, the sun gear and the internal gear around the same axis;

a slurry supplying unit for supplying a slurry to the work pieces;

a timer for measuring a polishing duration time;

a distance sensor mounted in a cavity of the upper polishing plate for measuring a distance from the distance sensor to an upper surface of the carrier; and a control unit configured to control the double side polisher so that a polishing operation for work pieces belonging to a first polishing group to start and finish starts and finishes based on the polishing duration time measured by the timer, a first calibration of the distance sensor is performed based on a difference between a thickness of the work pieces of the first polishing group calculated from the distance measured by the distance sensor and a thickness of the polished work pieces of the first polishing group measured by an external thickness measuring apparatus, a polishing operation for work pieces belonging to a second polishing group starts and finishes based on the distance measured by the calibrated distance sensor, and a second calibration of the distance sensor is performed based on a difference between a thickness of the work pieces of the second polishing group calculated from the distance measured by the distance sensor and a thickness of the polished work pieces of the second polishing group measured by the external thickness measuring apparatus.

4. A double side polisher according to claim 3, wherein the control unit comprises a target value storage unit to store target values of finishing thickness of the work pieces, and a calibration unit for performing the first and second calibrations of the distance sensor.

5. A double side polisher according to claim 4, wherein the control unit further comprises a sensor measurement storage for storing values of the distance measured by the distance sensor, and a work piece measurement storage for storing measured values of thickness of the polished work pieces.

6. A double side polisher according to claim 3, 4 or 5, wherein the distance sensor is an eddy current sensor, and the carrier, comprises a conductive upper surface.

* * * * *